United States Patent [19]

Schilling, deceased et al.

[11] Patent Number: 4,466,350

[45] Date of Patent: Aug. 21, 1984

[54] SHEET TRANSFER CYLINDER ASSEMBLY OF A SHEET-FED ROTARY PRINTING MACHINE HAVING A DEVICE FOR CORRECTING REGISTER OF OVERPRINTS

[76] Inventors: Paul Schilling, deceased, late of Neckargemünd, Fed. Rep. of Germany; by Erika Schilling, heir, Heidelberger Str. 2, 6903 Neckargemünd, Fed. Rep. of Germany

[21] Appl. No.: 363,849

[22] Filed: Mar. 31, 1982

[30] Foreign Application Priority Data

Apr. 1, 1981 [DE] Fed. Rep. of Germany ..... 3112964

[51] Int. Cl.[3] ..... B41F 21/05

[52] U.S. Cl. ..... 101/410; 101/230; 101/411

[58] Field of Search ..... 101/230, 409, 410, 411, 101/246; 271/82, 277

[56] References Cited

U.S. PATENT DOCUMENTS

| | | | |
|---|---|---|---|
| 2,577,099 | 12/1951 | Albrecht | 101/183 |
| 3,125,022 | 3/1964 | Reinartz et al. | 101/410 X |
| 3,534,683 | 10/1970 | Barthel | 271/82 X |

*Primary Examiner*—J. Reed Fisher

*Attorney, Agent, or Firm*—Herbert L. Lerner; Laurence A. Greenberg

[57] ABSTRACT

Sheet transfer cylinder assembly of a sheet-fed rotary printing machine including a sheet transfer cylinder and a device for correcting register of overprints on a sheet by deforming the leading edge of the sheet which includes a gripper fly supported on a shaft and swingably mounted on the sheet transfer cylinder, and a bending device carried by the sheet transfer cylinder in a middle region thereof, the bending device being cooperatively associated with the gripper fly and being actuatable by swinging movement of the gripper fly for flexing the shaft of the gripper fly and deforming the leading edge of the sheet in a direction tangential to the circumference of the cylinder.

9 Claims, 10 Drawing Figures

SHEET TRANSFER CYLINDER ASSEMBLY OF A SHEET-FED ROTARY PRINTING MACHINE HAVING A DEVICE FOR CORRECTING REGISTER OF OVERPRINTS

The invention relates to sheet transfer cylinders of sheet-fed rotary printing machines with a device for register correction of overprints by deformation of the leading edge of a sheet by means of flexure of the gripper fly shaft.

In sheet-fed rotary printing machines, the sheet experiences a slight dimensional change during overprinting. In multi-color printing, this results in a wider or narrower printing. The extent of this wider or narrower printing is essentially determined by the moisture content, the quality and evenness of the paper as well as by the size of the sheet to be printed. The additional wetting of the paper necessary with offset printing machines contributes to this phenomenon. In the case of multi-color sheet-fed rotary printing machines, this dimensional change is greatest for the first print, whereas it is no longer as significant for subsequent prints.

In order to allow corrective action in this process, the gripper flies of the sheet transfer cylinders of the printing machines thus affected are provided with regulating devices, the common feature of which is to influence the maintenance of register of the print by deforming the leading sheet edge in or opposite the sheet delivery direction of perpendicularly to this direction.

German Pat. No. 1 175 695 is cited herein initially as representing the state of the art, providing patent protection for a device including a respective gripper arrangement comprising a gripper pad and a gripper shaft carrying grippers located in sheet guiding devices i.e. in the feed drum, in the impression cylinder or in the transfer drums between or following the printing units, which is subdivided into individual sections along the leading edge of the sheet, catcher slides grasping both ends of the gripper shaft and of the gripper pad being installed at the junction of these sections, these slides being movable in the same or opposite direction of sheet delivery or transversely thereto.

In German Pat. No. 1 909 795, also worthy of note, a gripper bridge or fly is likewise subdivided into individual sections, each gripper pad bar provided for the gripper fly sections being additionally adjustable in height.

The division of the gripper fly into individual sections is therefore common to both of the foregoing German patents. Such a construction makes these devices quite costly. This applied in particular to the adjusting mechanisms for control of the individual gripper fly sections. By serially connecting a multiplicity of control elements subjected to tolerances, an exact transmission of the control instruction or command is impaired.

U.S. Pat. No. 2,577,099 is further respresentative of the state of the art. In the devices described therein, deformation of the leading edge of the sheet is achieved by flexure of the middle of the gripper fly shaft substantially in or opposite the direction of paper delivery. In the case of the first embodiment described in the U.S. patent, an elastic, tubular gripper fly shaft is held fast at the ends thereof in the impression cylinder while it rests within the cylinder gap or channel on two roller pairs. In each roller pair, one roller is adjustable by means of an eccentric so that the gripper fly shaft is deflected around the other roller in an arc.

In another embodiment of the U.S. patent, the gripper fly shaft is constructed as a flexible rod, deflection of which is achieved by means of an adjustable eccentic.

In the case of both embodiments of the U.S. patent, once gain the control mechanism involved for flexure is extremely complex and costly and, furthermore, is composed of several control elements.

Departing from this state of the art, it is an object of the invention to provide a device for register correction of overprints on a sheet transfer cylinder, with which given dimensional changes of the sheet can be accomplished exactly by deformation of the leading edge of the sheet. As a further object of the invention, the control system involved is to act directly on the gripper device and without the interaction or intermediate connection of further transfer elements.

It is also an object of the invention to provide such a device which ensures gentle handling of the leading edge of the sheet at all times.

With the foregoing and other objects in view there is provided, in accordance with the invention, a sheet transfer cylinder assembly of a sheet-fed rotary printing machine including a sheet transfer cylinder and a device for correcting register of overprints on a sheet by deforming the leading edge of the sheet including a gripper fly supported on a shaft and swingably mounted on the sheet transfer cylinder, and a bending device carried by the sheet transfer cylinder in a middle region thereof, the bending device being cooperatively associated with the gripper fly and being actuatable by swinging movement of the gripper fly for flexing the shaft of the gripper fly and deforming the leading edge of the sheet in a direction tangential to the circumference of the cylinder.

In accordance with other features of the invention, the deforming direction is either in direction of rotation of the cylinder or in opposite direction thereto.

The actual practice of constructing the gripper fly so that it is pivotable or swingable relative to the feed cylinder is already familiar from feed cylinders which take up the sheet from a feed table and pass it on to the impression cylinder, the aim being to achieve zero absolute velocity of the gripper during take-over from the feed table.

A pivotable or swingable construction of the gripper fly is also known heretofore from the turning cylinder on convertible single-side printing and perfecting presses, wherein the fly uses the grippers thereof to grip the trailing edge of the sheet to be turned. For the remainder of the printing process, the original trailing edge of the sheet then becomes the leading edge of the sheet.

These swinging or pivoting movements of the gripper fly are then utilized to fulfill the objective to be achieved by the invention.

The invention thus dispenses with additional drive and control elements for effecting flexure of the gripper fly shaft. The expenditure for additional components which might become necessary is minimal. Deformation of the leading sheet edge is always accomplished simultaneously with acceleration of the sheet, so that coordination of various sequences of movement is unnecessary. The continuously performed flexure of the gripper fly shaft and, thus, the deformation of the leading edge of the sheet, also ensures gentle handling of the sheet at all times.

This invention also takes into account adequately the fact that the dimensional change in the first printing unit is of decisive significance. Since, also with convertible single-side printing and perfecting presses as well, after turning, printing of the reverse side of the sheet must be considered anew as a first printing process, the device according to the invention also contributes to a significant extent in register correction of overprints of these machines.

In accordance with another feature of the invention, the shaft of the gripper fly is supported by a bearing substantially at the middle thereof, the bearing movable in and opposite the direction of rotation of the cylinder.

In accordance with a further feature of the invention, the shaft of the gripper fly is supported by a bearing substantially at the middle thereof, the bearing being pivotable about a pivot axis extending parallel to the axis of the cylinder and located on a supporting arm.

In accordance with an additional feature of the invention, there is provided a sheet-fed rotary printing machine having a feed table and a feed cylinder for taking up a paper sheet from the feed table, a device for deforming the leading edge of the sheet to correct register of overprints thereon, including a gripper fly supported on a shaft and pivotally mounted on the feed cylinder, pivotable bearing means supporting the gripper fly shaft at an intermediate location thereof, cam means for determing the position of the gripper fly shaft bearing means, the cam means being connected to the gripper fly shaft and being fixed against rotation relative thereto, the feed cylinder being mounted on a shaft, a supporting arm carried by the feed-cylinder shaft, the supporting arm bearing a roller, the cam means, during pivoting movement of the gripper fly relative to the feed cylinder, being in rolling contact with the roller borne by the supporting arm and restoring spring means for applying yieldable force against the gripper fly shaft bearing means and pressing the bearing means through the intermediary of the cam means against the roller.

In accordance with an added feature of the invention, there is provided a sheet-fed rotary printing machine convertible between printing on one side of a sheet and perfector printing and having a turning cylinder for turning over a paper sheet, a device for deforming the leading edge of the sheet to correct register of overprints thereon, including a gripper fly supported on a shaft and pivotally mounted on the turning cylinder, pivotable bearing means supporting the gripper fly shaft at an intermediate location thereof, cam means for determining the position of the gripper fly bearing means, the cam means being connected to the gripper fly shaft and being fixed against rotation relative thereto, the turning cylinder being mounted on a shaft, a supporting arm carried by the turning-cylinder shaft, the supporting arm bearing a roller, the cam means, during pivoting movement of the gripper fly relative to the turning cylinder, being in rolling contact with the roller borne by the supporting arm, a tilting lever articulatingly mounted on the supporting arm, and restoring spring means for yielding pressing the gripper fly shaft bearing means through the intermediary of the tilting lever and the cam means against the roller.

In accordance with yet another feature of the invention, a shaft supporting the gripper fly, pivotable bearing means supporting the shaft at an intermediate location thereof on the sheet transfer cylinder, cam means formed with a recess for determining the position of the bearing means, the cam means being connected to the shaft and fixed against rotation relative thereto, a shaft supporting the sheet transfer cylinder, a supporting arm carried by the shaft supporting the sheet transfer cylinder, the supporting arm bearing a roller engaging in the recess formed in the cam means after take-up of a sheet by the sheet transfer cylinder.

In accordance with yet a further feature of the invention, a shaft supporting the gripper fly, pivotable bearing means supporting the shaft at an intermediate location thereof on the sheet transfer cylinder, cam means formed with a rise for determining the position of the bearing means, the cam means being connected to the shaft and fixed against rotation relative thereto, a shaft supporting the sheet transfer cylinder, the supporting arm bearing a roller disposed in rolling contact with the rise on the cam means after take-up of a sheet by the sheet transfer cylinder.

In accordance with yet an additional feature of the invention, a shaft supporting the gripper fly, pivotable bearing means supporting the shaft at an intermediate location thereof on the sheet transfer cylinder, cam means formed with a recess for determining the position of the bearing means, a shaft supporting the sheet transfer cylinder, a supporting arm carried by the shaft supporting the sheet transfer cylinder, the supporting arm bearing a roller, the cam means being turnably and fixably mounted on the griper fly shaft so as to engage the roller in the recess formed in the cam means as soon as a sheet has been taken up by the sheet transfer cylinder.

In accordance with yet an added feature of the invention, the cam means are turnably and fixably supported on the gripper-fly shaft for adjusting the extent of yieldable force application against the gripper-fly shaft bearing means.

In accordance with a concomitant feature of the invention, the gripper-fly shaft bearing means have a pivot range, and including an adjusting screw carried by the cam means for adjusting the pivot range so as to adjust the extent of yieldable force application against the gripper-fly shaft bearing means.

Other features which are considered as characteristic for the invention are set forth in the appended claims.

Although the invention is illustrated and described herein as embodiment in sheet transfer cylinder assembly of a sheet-fed rotary printing machine having a device for correcting register of overprints, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
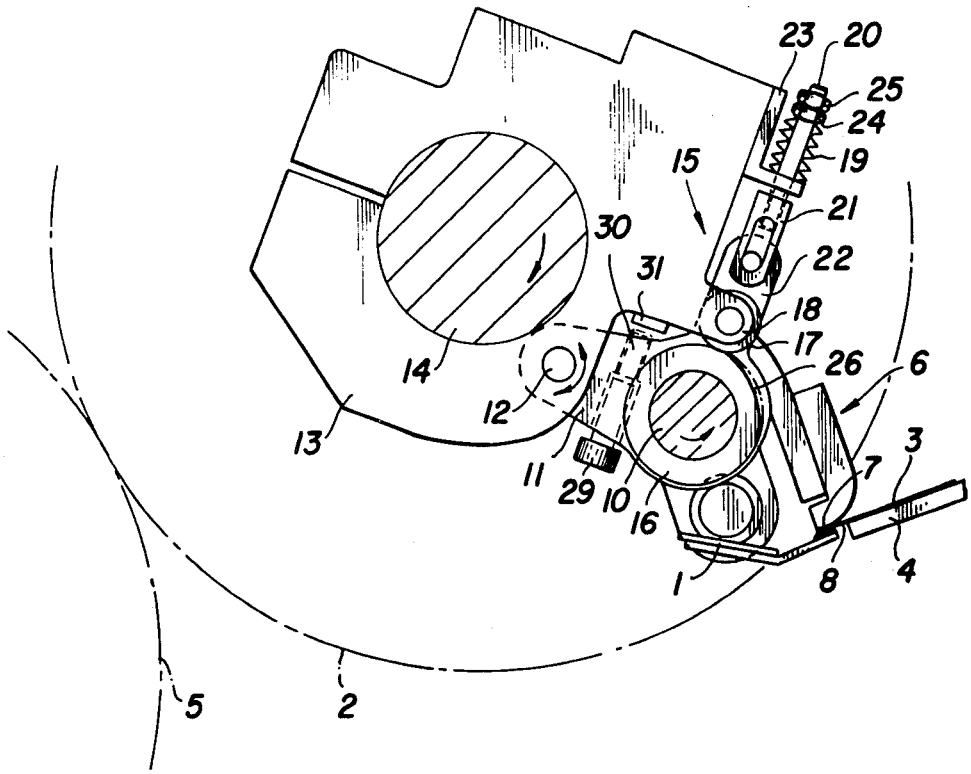
FIG. 1 is a diagrammatic side elevational view of a feed cylinder with a bending device according to the invention.

Referring now to the drawing and first, particularly, to FIG. 1 thereof, there are shown grippers 1 of a feed cylinder 2 taking up from a feed table 4 a paper sheet 3 to be printed, and then passing it onto an impression cylinder 5. The sheet 3 experiences an acceleration which takes it from an absolute velocity of zero, which it has during transfer from the feed table 4, up to the circumferential speed of the cylinder 2 for transfer onto the impression cylinder 5.

For this purpose, a gripper fly or bridge 6 is constructed so that it is swingable or pivotable relative to the feed cylinder 2. Control of the swinging movement of the gripper fly 6 is effected so that it performs an overtravel motion shortly before take-up of the sheet 3, and swings back into the initial position thereof during take-up and further transport of the sheet. At the instant of sheet take-up, the return swing speed of the gripper pad 7 is equal to the negative circumferential speed of the cylinder 2, so that an absolute velocity equal to zero results. On the other hand, during sheet transfer to the impression cylinder 5, the gripper fly 6 does not swing any more.

With the device shown in FIG. 1, making use of the swinging movement of the gripper fly 6, the middle of the leading edge 8 of the sheet 3 is deformed in or opposite the direction of paper delivery after take-up of the sheet 3 from the feed table 4 until transfer thereof to the impression cylinder 5.

In the interest of clarity, the mechanisms for control of the swinging movement of the gripper fly 6 as well as for control of the closing movement of the grippers 1 are not shown. They are clearly known from the state of the art as exemplified by German Published Prosecuted Application (DE-AS) No. 25 57 866.

Whereas the two outer bearings 9 of the gripper fly shaft 10 are fixed in the feed cylinder 2, the middle bearing 11 of the gripper fly shaft 10, shown in FIG. 1, is mounted in a bearing movable about a point of rotation 12 substantially in or opposite the rotational direction of the cylinder 2, the point of rotation 12 being located on a supporting arm 13. The supporting arm 13 is mounted so as to be fixed against rotation on the cylinder axis 14 and bears the entire bending device 15 for bending the gripper fly shaft 10.

The position of the middle bearing 11 of the gripper fly shaft 10 is determined by a cam 16, which is mounted in a fixed bearing on the gripper fly shaft 10 and, during the swinging movement of the shaft 10, runs against a roller 17, which is, in turn, mounted on a stirrup or bracket 18 of the supporting arm 13.

Continuous contact of the cam 16 with the roller 17 is ensured by a restoring or return spring 19, which presses the middle gripper fly shaft bearing 11 and the cam 16, respectively, against the roller 17 by means of a threaded member 20, a connecting rod 21 and a bearing arm 22. The position of the restoring spring 19 is set by a stop thereof on an elbow 23 bolted onto the supporting arm 13. The pretensioning force of the spring 19 is determined by a pretensioning nut 24 provided at the other end of the threaded member 20. An additional jam nut 25 serves as a safety device.

Figure 2:
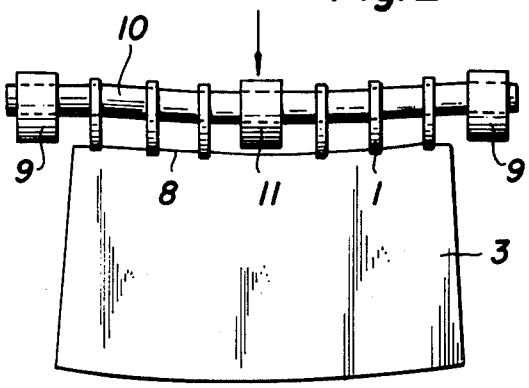
FIG. 2 is a fragmentary view of FIG. 1 from the right-hand side thereof showing the tensioning of a sheet achievable with the device illustrated in FIG. 1.

Tensioning of the leading edge 8 of the sheet 3 and flexure of the gripper fly shaft 10, respectively, opposite the rotational direction of the cylinder 2 is accomplished by providing the cam 16 with a recess 26 within which the roller 17 engages during the swinging motion. The resilience or spring force of the restoring spring 19 always ensures continuous contact of the cam 16 with the roller 17, thus causing flexure or bending of the gripper fly shaft 10, as the middle bearing 11 of the shaft 10 pivots about the point of rotation 12 by an amount equivalent to the resilience or force of the spring 19. FIG. 2 clearly shows the deformation of the leading edge 8 of the sheet 3 achieved by the device of FIG. 1.

Figure 3:
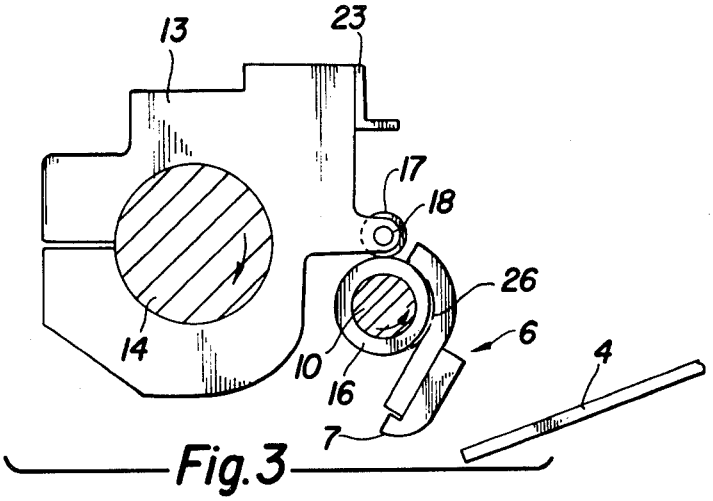
FIGS. 3 to 5 are fragmentary views of FIG. 1, reduced in size, and showing the swinging movement of the gripper fly superimposed on the cylinder movement, in various modes of operation thereof, usually in overtravel, sheet take-up as well as sheet transfer positions thereof.
Figure 4:
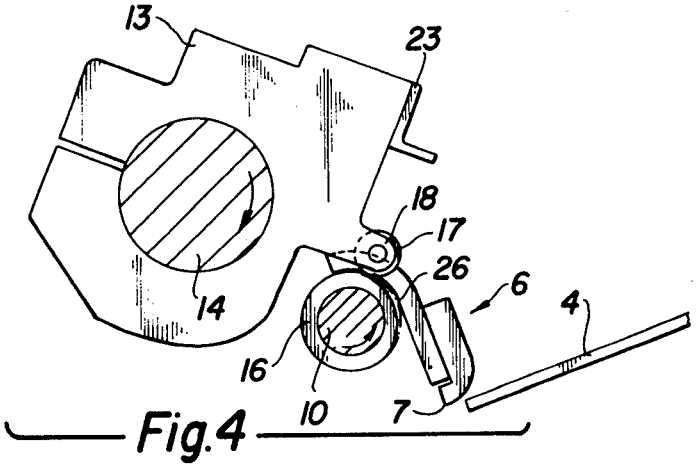
Figure 5:
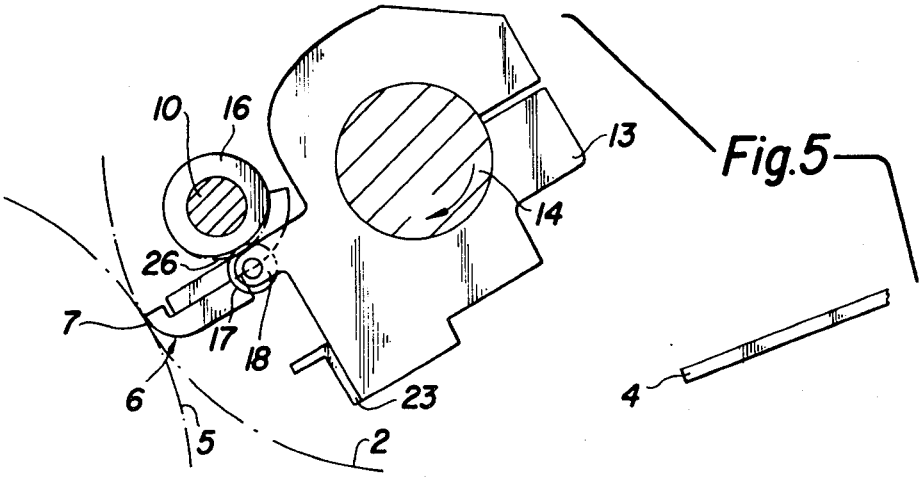

FIGS. 3 to 5 show the modes or stages of operation or sequence of movements of the gripper fly 6 before sheet take-up from the feed table 4 until sheet transfer to the impression cylinder 5. Furthermore, the interaction between the cam 16 and the roller 17 during the swinging movement of the gripper fly 6 can be seen in these figures.

FIG. 3 shows in detail the overtravel of the gripper fly 6 shortly before sheet take-up from the feed table 4.

In addition, FIG. 4 shows the gripper fly 6 swinging back to the position thereof during sheet transfer, and FIG. 5 shows transfer of the sheet to the impression cylinder 5.

Figure 6:
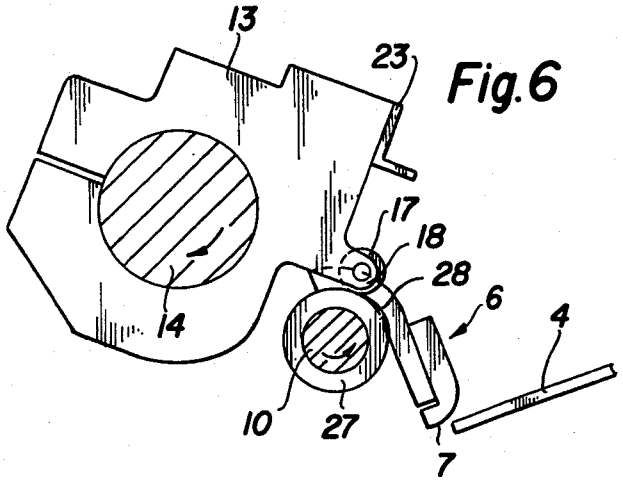
FIG. 6 is a fragmentary view of FIG. 1, reduced in size, and having a different cam.

The device shown in FIG. 6 differs from that shown in FIG. 1 in that the cam 27 has a rise or raised portion 28. This has the result that, with an otherwise uniform sequence of movement of the gripper fly 6 (note FIGS. 3 to 5), the tensioning of the leading edge 8 of the sheet 3 and bending or flexure of the gripper fly shaft 10, respectively, are now in direction of cylinder rotation.

Figure 7:
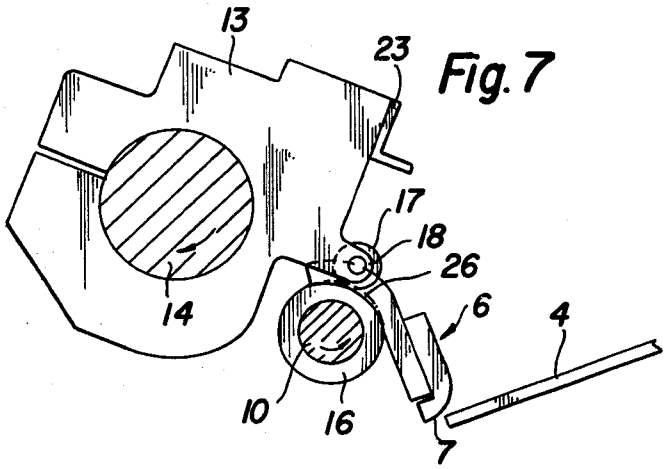
FIG. 7 is a fragmentary view of FIG. 1, reduced in size, and having a cam turned through approximately 45° counterclockwise.

The same result, however, might also be achieved by simply turning the cam 16 shown in FIG. 1 through substantially 45° counterclockwise, as shown in FIG. 7, thereby selecting the initial position so that the roller 17 previously engages in the recess 26 of the cam 16 during sheet take-up from the feed table 4, the roller 17 then cooperating with the cylindrical part of the cam 16 during sheet transfer.

Figure 8:
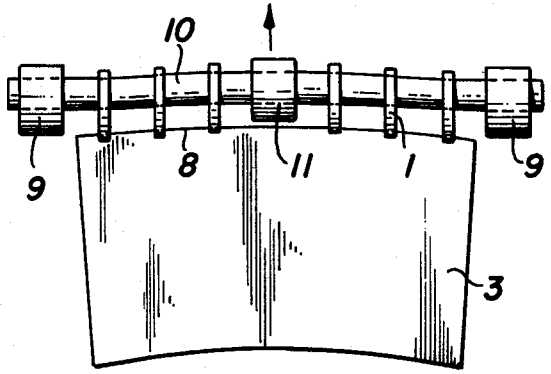
FIG. 8 is a view similar to that of FIG. 2 and showing the tensioning of a sheet achievable with the devices shown in FIGS. 6 and 7.

FIG. 8 shows the deformation of the leading edge 8 of the sheet 3 achieved with cams and the arrangement thereof in accordance with FIGS. 6 and 7, respectively.

Hereinafter is a description of two possible ways of setting or adjusting the extent of tensioning of the leading edge 8 of the sheet 3.

One way is to use an adjusting screw 29, which engages in a threaded section 30 of the middle gripper fly shaft bearing 11 and limits the swinging range of this gripper fly shaft bearing 11 by means of a stop 31 located on the supporting arm 13. By using a cam 16 provided with a recess 26, it is possible to prevent the roller 17 from swinging the gripper fly 6 appropriately. When using a cam 27 provided with a rise or elevation 28, the adjusting screws 29, even in the initial position, presses the cam 27 slightly away from the roller 17, so that the rise up to the highest point of the elevation 28 is reduced.

Another non-illustrated possibility of limiting the degree of tensioning of the leading edge of the sheet is to mount the respective cam 16, 27 on the gripper fly shaft 10 in such a way that it can be turned and fixed. Depending upon the amount of tensioning required, the respective cam 16, 27 is turned with respect to the gripper fly shaft 10 in such a way that the initial position thereof is changed. Because the pivoting or swinging angle of the gripper fly 6 remains unchanged, the cam 16, at a location thereof not yet at the deepest point of the recess 26, as well as the cam 27 at a location not yet at the highest point of the elevation 28, cooperates with the roller 17 during transfer of the sheet 3 to the impression cylinder 5.

Both of the possibilities described hereinbefore therefore permit infinitely variable setting or adjustment of the extent of tensioning.

Figure 9:
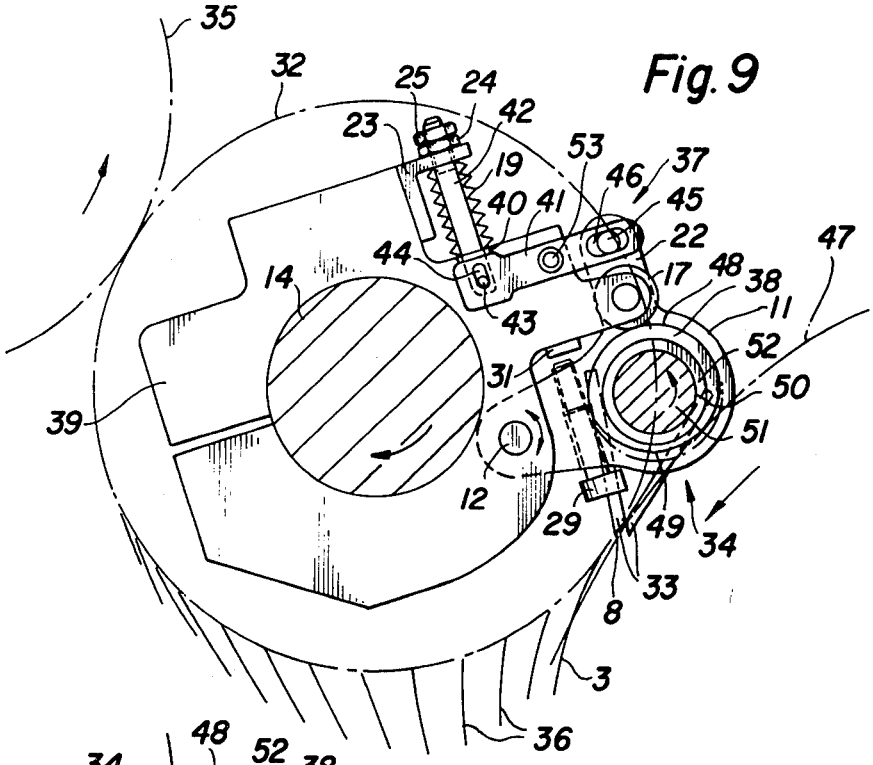
FIG. 9 is a diagrammatic side elevational view of a turning cylinder with the bending device according to the invention, during sheet take-up mode of operation thereof.

With the turning cylinder 32 shown in FIG. 9, the tongs grippers 33 seize the trailing edge of the paper sheet 3. From this instant on, this trailing edge of the sheet becomes the leading edge of the sheet for further printing, and is so referred to hereinafter. A consequent re-naming of the heretofore referred to leading edge of the sheet is likewise applicable so that it is hereinafter referred to as the trailing edge.

During further transport, the gripper fly 34 is pivoted relative to the turning cylinder 32 and transfers the thus turned sheet 3 to the impression cylinder 35 of the next printing unit. As with the feed cylinder 2, the swinging movement of the gripper fly 34 is once again utilized to deform the middle of the sheet 3 in or opposite the direction of delivery of the paper.

In the interest of clarity, the mechanisms for control of the swinging movement of the gripper fly 34 as well as for controlling the closing movement of the tongs grippers 33 are also not shown. Once again, reference may be had to the publications or patents representing the state of the art, such as German Pat. No. 25 47 251, for example.

The swinging movement of the gripper fly 34 until sheet transfer can be seen by the consecutive lines 36 indicating the direction of swing thereof in FIG. 9.

The basic construction of the bending or flexing device 37 corresponds to the embodiment shown in FIG. 1.

Only the disposition of the restoring spring 19, which ensures continuous contact of the cam 38 with the roller 17, has been modified somewhat for reasons of space (bending device 37 as much as possible within the outer radius of the turning cylinder 32).

Thus the position of the restoring spring 19, which acts once again as a compression spring, is determined by the stop thereof on an elbow 23 bolted to a slightly modified supporting arm 39.

The other side of the restoring spring 19 pushes, through the intermediary of a movable washer 40, against one of the arms of a tilting lever 41, which is mounted on a joint 53 of the supporting arm 39, thus ensuring continuous contact of the cam 38 with the roller 17 by means of the middle gripper fly shaft bearing 11 articulatingly connected to the other arm of the tilting lever 41. Longitudinal guidance of the restoring spring 19 is effected by means of a guide rod 42. The exact position thereof is determined by a pretensioning nut 24 at the other end of the rod 42. An additional jam nut 25 serves as a safety device. A bolt or pin 43 on the guide rod 42 cooperates with an elongated slot 44 of the pivoted lever 41. Another bearing bolt or pin 45 on the bearing arm 22 of the middle gripper fly shaft bearing 11 likewise cooperates with another elongated slot 46 in the other arm of the tilting lever 41.

Due to the fact that the pivoting or swinging angle of the gripper fly 34 on the turning cylinder 32 is approximately 180°, a somewhat modified cam 38 is again required.

Furthermore, in order to ensure that flexure of the leading edge 8 of the sheet 3 does not occur until the trailing edge of the sheet 3 is clear of the storage drum 47, the cylindrical cam section 48 of the cam 38 also cooperates with the roller 17 for an appropriate period of time.

Figure 10:
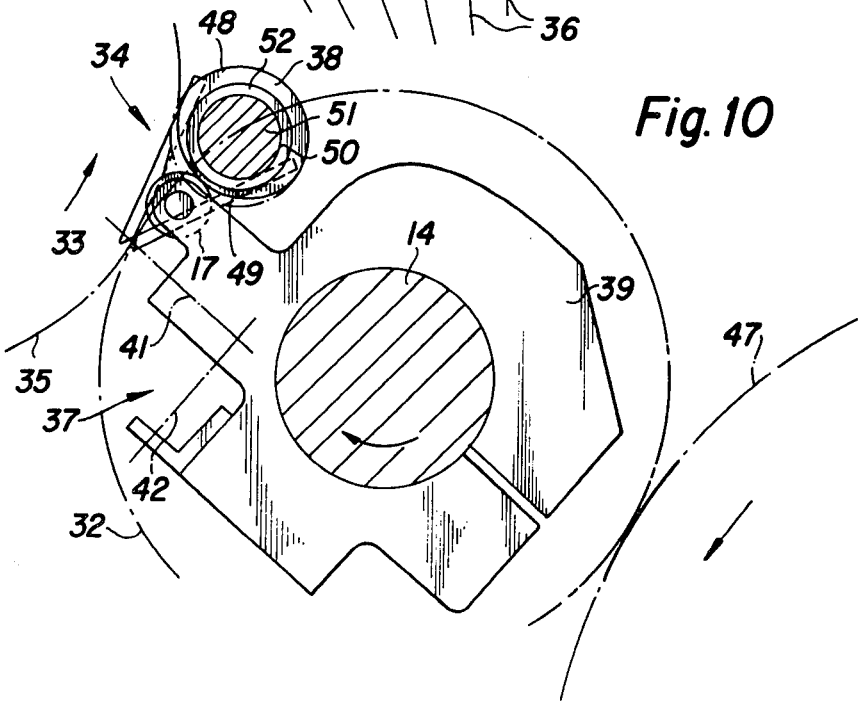
FIG. 10 is another view of FIG. 9 showing the turning cylinder with the pivoted or swung gripper fly in a different mode of operation thereof, namely the sheet transfer position.

FIG. 10 shows the sheet transfer position at the impression cylinder 35 of the next printing unit. The interaction or cooperation between the recess 49, the cam 38 and the roller 17 in this position is also shown in this figure. Finally, a further point worth mentioning is that, in the device on the turning cylinder 32, the gripper fly shaft 50 carrying the tongs or tweezer grippers 33 is made up of a shaft 51 and a tube 52 mounted thereon.

Possible methods of tensioning the sheet 3 in and opposite the running or rotating direction of the cylinder when using the device on the turning cylinder 32, as well as ways of setting and limiting, respectively, the extent of tensioning, are relatively easy to derive from the embodiments shown in FIGS. 1 to 8 and therefore require no further explanation.

The invention is, of course, not limited to the embodiments shown in the drawings. Application of the inventive concept to the many possible structural variations of sheet transfer cylinders also requires, in some circumstances, slightly modified bending devices for deforming the leading edge of the sheet. This applies to the bending device of the invention per se as well as to the possible methods and means for tensioning the sheet in and opposite to the travel or rotary direction of the cylinder and for setting and limiting, respectively, the extent of tensioning. For example, a conceivable alternative to controlling the flexure of the gripper fly shaft by means of a cam is also a solution using eccentric control. This would involve, for example, mounting the middle bearing of the gripper fly shaft of the feed cylinder in a non-movable bearing. Instead, the gripper fly shaft would have to be eccentrically offset in this region, so that the axis of the section of gripper fly shaft carrying the grippers would display a given eccentricity with respect to the middle gripper fly shaft bearing.

There are claimed:

1. Sheet transfer cylinder assembly of a sheet fed rotary printing machine including a sheet transfer cylinder rotatable in a given rotational direction and a device for correcting register of overprints on a sheet by deforming the leading edge of the sheet, comprising a gripper fly supported on a shaft, said shaft being mounted on the sheet transfer cylinder so as to be swingable relative to the rotary motion of its sheet transfer cylinder, a bending device carried by the sheet transfer cylinder in a middle region thereof, and means for actuating said bending device in accordance with the swinging movement of said gripper fly for flexing said shaft of said gripper fly and deforming the leading edge of the sheet in a direction tangential to the circumference of the cylinder, said shaft of said gripper fly being supported by a bearing substantially at the middle thereof, and including means for pivoting said bearing in the direction of rotation of the cylinder and opposite the direction of rotation of the cylinder.

2. Sheet transfer cylinder assembly of a sheet fed rotary printing machine including a sheet transfer cylinder rotatable in a given rotational direction and a device for correcting register of overprints on a sheet by deforming the leading edge of the sheet comprising a gripper fly supported on a shaft, said shaft being mounted on the sheet transfer cylinder so as to be swingable relative to the rotary motion of its sheet transfer cylinder, a bending device carried by the sheet transfer cylinder in a middle region thereof, means for actuating said bending device in accordance with the swinging movement of said gripper fly for flexing said shaft of said gripper fly and deforming the leading edge of the sheet in a direction tangential to the circumference of the cylinder, and a cylinder shaft rotatably supporting the transfer cylinder and carrying a supporting arm, said shaft of said gripper fly being supported by a bearing substantially at the middle thereof, said bearing being pivotable about a pivot axis extending parallel to the axis of the cylinder and located on said supporting arm.

3. In a sheet-fed rotary printing machine having a feed table and a feed cylinder for taking up a paper sheet from the feed table, a device for deforming the leading edge of the sheet to correct register of overprints thereon, comprising a gripper fly supported on a shaft and pivotally mounted on the feed cylinder, pivotable bearing means supporting said gripper fly shaft at an intermediate location thereof, cam means for determining the position of said gripper fly shaft bearing means, said cam means being connected to said gripper fly shaft and being fixed against rotation relative thereto, the feed cylinder being mounted on a shaft, a supporting arm carried by said feed-cylinder shaft, said supporting arm bearing a roller; said cam means, during pivoting movement of said gripper fly relative to the feed cylinder, being in rolling contact with said roller borne by said supporting arm, and restoring spring means for applying yieldable force against said gripper fly shaft bearing means and pressing said bearing means through the intermediary of said cam means against said roller.

4. In a sheet-fed rotary printing machine convertible between printing on one side of a sheet and perfector printing and having a turning cylinder for turning over a paper sheet, a device for deforming the leading edge of the sheet to correct register of overprints thereon, comprising a gripper fly supported on a shaft and pivotally mounted on the turning cylinder, pivotable bearing means supporting said gripper fly shaft at an intermediate location thereof, cam means for determining the position of said gripper fly bearing means, said cam means being connected to said gripper fly shaft and being fixed against rotation relative thereto, the turning cylinder being mounted on a shaft, a supporting arm carried by said turning-cylinder shaft, said supporting arm bearing a roller, said cam means, during pivoting movement of said gripper fly relative to the turning cylinder, being in rolling contact with said roller borne by said supporting arm, a tilting lever articulatingly mounted on said supporting arm, and restoring spring means for yieldably pressing said gripper fly shaft bearing means through the intermediary of said tilting lever and said cam means against said roller.

5. Sheet transfer cylinder assembly of a sheet fed rotary printing machine including a sheet transfer cylinder rotatable in a given rotational direction and a device for correcting register of overprints on a sheet by deforming the leading edge of the sheet, comprising a gripper fly supported on a shaft, said shaft being mounted on the sheet transfer cylinder so as to be swingable relative to the rotary motion of its sheet transfer cylinder, a bending device carried by the sheet transfer cylinder in a middle region thereof, and means for actuating said bending device in accordance with the swinging movement of said gripper fly for flexing said shaft of said gripper fly and deforming the leading edge of the sheet in a direction tangential to the circumference of the cylinder, said deforming direction being opposite the direction of rotation of the cylinder, pivotable bearing means supporting said shaft at an intermediate location thereof on the sheet transfer cylinder, cam means formed with a recess for determining the position of said bearing means, said cam means being connected to said shaft and fixed against rotation relative thereto, a shaft supporting the sheet transfer cylinder, and a supporting arm carried by said transfer cylinder shaft, said supporting arm bearing a roller engaging in said recess formed in said cam means after take-up of a sheet by the sheet transfer cylinder.

6. Sheet transfer cylinder assembly of a sheet fed rotary printing machine including a sheet transfer cylinder rotatable in a given rotational direction and a device for correcting register of overprints on a sheet by deforming the leading edge of the sheet, comprising a gripper fly supported on a shaft, said shaft being mounted on the sheet transfer cylinder so as to be swingable relative to the rotary motion of its sheet transfer cylinder, a bending device carried by the sheet transfer cylinder in a middle region thereof, means for actuating said bending device in accordance with the swinging movement of said gripper fly for flexing said shaft of said gripper fly and deforming the leading edge of the sheet in a direction tangential to the circumference of the cylinder, said deforming direction being in direction of rotation of the cylinder, pivotable bearing means supporting said shaft at an intermediate location thereof on the sheet transfer cylinder, cam means formed with a rise for determining the position of said bearing means, said cam means being connected to said shaft and fixed against rotation relative thereto, a shaft supporting the sheet transfer cylinder, and a supporting arm carried by said shaft supporting the sheet transfer cylinder, said supporting arm bearing a roller disposed in rolling contact with said rise on said cam means after take-up of a sheet by the sheet transfer cylinder.

7. Sheet transfer cylinder assembly of a sheet fed rotary printing machine including a sheet transfer cylinder rotatable in a given rotational direction and a device for correcting register overprints on a sheet by deforming the leading edge of the sheet, comprising a gripper fly supported on a shaft, said shaft being mounted on the sheet transfer cylinder so as to be swingable relative to the rotary motion of its sheet transfer cylinder, a bending device carried by the sheet transfer cylinder in a middle region thereof, means for actuating said bending device in accordance with the swinging movement of said gripper fly for flexing said shaft of said gripper fly and deforming the leading edge of the sheet in a direction tangential to the circumference of the cylinder, said deforming direction being in direction of rotation of the cylinder, pivotable bearing means supporting said shaft at an intermediate location thereof on the sheet transfer cylinder, cam means formed with a recess for determining the position of said bearing means, a shaft supporting the sheet transfer cylinder, and a supporting arm carried by said transfer cylinder shaft, said supporting arm bearing a roller, said cam means being turnably and fixably mounted on said gripper fly shaft so as to engage said roller in said recess formed in said cam means as soon as a sheet has been taken up by the sheet transfer cylinder.

8. In a sheet fed rotary printing machine according to claim 3 or 4 wherein said cam means are turnably and fixably supported on said gripper-fly shaft for adjusting the extent of yieldable force application against said gripper-fly shaft bearing means.

9. In a sheet-fed rotary printing machine according to claim 3 or 4 wherein said gripper-fly shaft bearing means have a pivot range, and including an adjusting screw carried by said cam means for adjusting said pivot range so as to adjust the extent of yieldable force application against said gripper-fly shaft bearing means.

* * * * *